United States Patent [19]

Pfeifer

[11] Patent Number: 4,593,824

[45] Date of Patent: Jun. 10, 1986

[54] TAG HOLDER

[75] Inventor: William Pfeifer, Springdale, Pa.

[73] Assignee: Armstrong Store Fixture Corporation, Pittsburgh, Pa.

[21] Appl. No.: 681,654

[22] Filed: Dec. 14, 1984

[51] Int. Cl.[4] ..... A47F 5/00

[52] U.S. Cl. ..... 211/57.1; 40/10 R; 40/16.4; 248/220.3

[58] Field of Search ..... 211/57.1, 59.1, 94, 211/106; 248/220.3, 220.2, 220.4, 221.1, 221.2; 40/16, 16.4, 10 R, 16.2

[56] References Cited

U.S. PATENT DOCUMENTS

| | | | |
|---|---|---|---|
| 1,033,915 | 7/1912 | McDonald . | |
| 1,344,079 | 6/1920 | Frost | 40/16.4 X |
| 1,743,266 | 1/1930 | Burns | 40/16.4 |
| 2,895,241 | 7/1959 | Ferdinand et al. | 40/16.4 X |
| 4,094,415 | 6/1978 | Larson | 248/220.3 X |
| 4,140,224 | 2/1979 | Celeste | 211/134 |
| 4,246,710 | 1/1981 | Mixer | 40/16.4 |
| 4,295,288 | 10/1981 | Westberg | 40/16.4 |
| 4,319,731 | 3/1982 | Pfeifer | 248/223.4 |
| 4,351,440 | 9/1982 | Thalenfeld | 211/57.1 |
| 4,405,051 | 9/1983 | Thalenfeld | 211/57.1 |

FOREIGN PATENT DOCUMENTS

| | | | |
|---|---|---|---|
| 408628 | 9/1966 | Switzerland | 40/16.4 |

OTHER PUBLICATIONS

Caliform Fabrication, Inc. Catalogue "Pip-Hook" Product Identification Peghook, p. 2.

*Primary Examiner*—Robert W. Gibson, Jr.
*Attorney, Agent, or Firm*—Parmelee, Miller, Welsh & Kratz

[57] ABSTRACT

An extruded or injection molded, resilient resin tag holder comprises a planar member with a pair of parallel flanges projecting transversely from the rear face and a rib projecting from at least one flange toward the other. The flanges are spread apart to snap the rib over and firmly grip the transversely bent end portion of a support rod with the shaft of the rod passing through a notch in the rib. A plurality of notches spaced along the rib provide selective lateral positioning of the tag holder relative to the support rod shaft. The end of the flanges beyond the rib bear against the rod shaft to prevent rotation of the tag holder about the transversely bent end portion of the rod. One embodiment includes a second notched rib spaced from the first by an amount which may be selectively used to accommodate a support rod of larger cross-section. The top and bottom edges of the planar member are bent over the front face to form slots for retaining a tag in the holder with the upturned lower edge also forming a support ledge for a tag scanner.

9 Claims, 6 Drawing Figures

TAG HOLDER

BACKGROUND OF THE INVENTION

1. Field of the Invention

This invention relates to holder for tags used to display information about merchandise and more particularly it relates to a one piece tag holder which snaps over the transversely turned end of a support rod that extends outward generally horizontally from a support structure.

2. Prior Art

It is common practice to display many types of merchandise on cards hung on a hook which extends horizontally outward from a support. In many such installations, information related to the carded merchandise such as identification of the product, price and/or inventory data is presented on a tag carried on the end of a tag support rod extending horizontally outward above the merchandise hook. Such an arrangement not only prominantly displays the pertinent information about the carded merchandise, but the tag holder often serves as a guard to prevent the turned up end of the merchandise hook from causing injury to those passing by.

In my tag holder disclosed in commonly owned U.S. Pat. No. 4,319,731, a continuous rib projecting from one flange toward the other of a pair of parallel flanges on the back face of a planar member engages a transverse slot cut in the shaft of a support rod adjacent the transversely turned terminal portion of the rod. The shaft of the support rod is thus gripped between the rib and the opposed flange and the transversely turned end portion of the shaft is gripped between the flanges, the back of the planar member and the rib. While this arrangement secures the tag holder to the support rod adequately, a groove must be cut in the shaft of the support rod which requires an additional manufacturing step and necessarily weakens the shaft. Also the rib can only overlap the transversely bent end portion of the rod by an amount dictated by the depth of the groove cut in the support rod shaft. Preferably, the terminal portion of the shaft is bent to form an offset section which provides a tight friction fit for the tag holder and prevents it from being rotated about the axis of the terminal portion. Again, this requires a specialized support rod.

The tag holder of U.S. Pat. No. 4,319,731 is extruded from a resilient resin material with the top and bottom edges turned over on the front face of the planar member to define opposed slots in which a tag bearing the desired information is retained. The bottom lip is spaced farther from the front face of the planar member than the top lip to form a ledge which can support a scanner for computer based inventory system as the scanner is passed over the tag to enter the recorded information into the computer.

The primary object of the present invention is to provide an improved tag holder which can tightly grip the transversely turned end of a support rod and resist rotation about the rod and which does not require cutting slots, bending offsets or other customizing modifications to the support shaft.

SUMMARY OF THE INVENTION

The above and other objects are realized by a tag holder which comprises a resilient planar member with a pair of integral, parallel flanges projecting transversely from the rear face thereof and with a rib projecting from at least one flange toward the other and having a notch in its free edge. The flanges are spaced apart, the rib is spaced from the rear face of the planar member and the notch is sized such that the flanges may be spread apart to snap the rib over the transversely bent end portion of a support rod with the shaft of the rod extending through the notch to snuggly grip the end portion of the support rod between the flanges and between the rib and the rear face of the planar member. A plurality of notches may be spaced along the rib to provide selective lateral positioning of the tag holder relative to the support rod shaft. The flanges preferably extend rearward from the rear face of the planar member beyond the rib, so that they bear against the top and bottom respectively of the support rod shaft to prevent rotation of the tag holder about the transversely turned end portion. This structural arrangement provides a firm, easily effected attachment of the tag holder to a support rod with a transversely bent end portion without requiring any modification to the rod. One embodiment includes a second notched rib spaced outward from the first rib by an amount which may be used to selectively accommodate a support rod of larger cross-section.

BRIEF DESCRIPTION OF THE DRAWINGS

A full understanding of the invention can be gained from the following description taken in conjunction with the accompanying drawings in which.

DESCRIPTION OF THE PREFERRED EMBODIMENT

Figure 1:
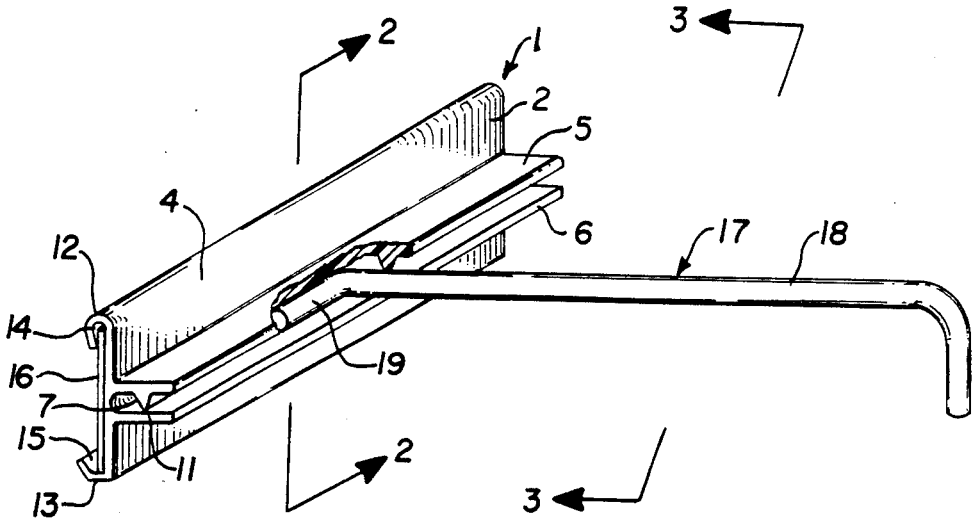
FIG. 1 is an isometric view with parts broken away of a tag holder according to the invention as observed from a position to the rear, above, and to one side and showing engagement of the tag holder with a support rod having a transversely bent end portion.

As shown in the drawings, the tag holder 1 of the invention comprises a planar member 2 having a front face 3 and a rear face 4. A pair of integral flanges 5 and 6 project transversely from the rear face 4, and an integral rib 7 projects downward from the flange 5 toward the flange 6. The flanges 5 and 6 and rib 7 extend across a substantial portion, preferably the full width, of the rear face 4. Also, the terminal portions 8 and 9 of the flanges 5 and 6 respectively extend outward beyond the rib 7. A notch 10 is provided in the free edge 11 of the rib 7.

The top edge 12 and bottom edge 13 of the planar member 2 are preferably bent over the front face 3 to form upper and lower slots 14 and 15 respectively in which a tag 16 may be retained. The upper slot 14 is made tight to firmly grip the tag 16. The upwardly bent lower edge 13 stands out somewhat from the tag 16 to form a ledge on which a scanner gun (not shown) may be rested as it is passed across the tag holder to "read" inventory information carried by the tag 16 as is conventional.

The tag holder 1 is made from a resilient resin such as for example, polycarbonate, polyvinyl chloride, impact styrene, high or low density polyethylene, or polyethylene terephthalate (PET) but is preferably extruded from cellulose acetate butyrate. The notch 10 is punched in the rib 7 as the continuous length of extruded material emerges from the extruder. The notched length is then cut into individual tag holders 1, preferably with the notch 10 centered between the side edges. The tag holders can also be injection molded.

The tag holder 1 is adapted for use with a generally horizontally extending support rod 17 having a shaft portion 18 and a transversely bent end portion 19. The manner of support for the rod 17 is immaterial to the present invention, but in most cases, would take the form of a bracket which is mounted on a perforated board, a vertical support, or a horizontal bar. It is expected, but not essential to the invention, that the tag holder support rod 17 would project horizontally out from the support above a hook for carded merchandise much like the arrangement shown in U.S. Pat. No. 4,319,731 which is hereby incorporated by reference in order to illustrate an environment in which the invention could be used.

To mount the tag holder 1 onto the support rod 17, the flanges 5 and 6 are pulled apart so that the rib 7 may be snapped over the transversely bent end portion 19 of the rod with the shaft portion 18 extending through the notch. The spacing of the rib 7 from the rear face 4 of the planar member 2, the distance between the flanges 5 and 6 and the size of the notch 10 is such that the end portion 19 of the support rod 17 is firmly gripped. The notch 10 may be somewhat elongated as shown to accommodate the radius of the bend in the shaft 17. The terminal portions 8 and 9 and the flanges 5 and 6 bear against the top and bottom surfaces of the shaft 18 to prevent rotation of the tag holder about the end portion 19. Additional notches 10' and 10'' may be spaced along the rib 7 to provide the opportunity for selective lateral alignment of the tag holder 1 with respect to the shaft 18 of the support rod 17.

Figure 2:
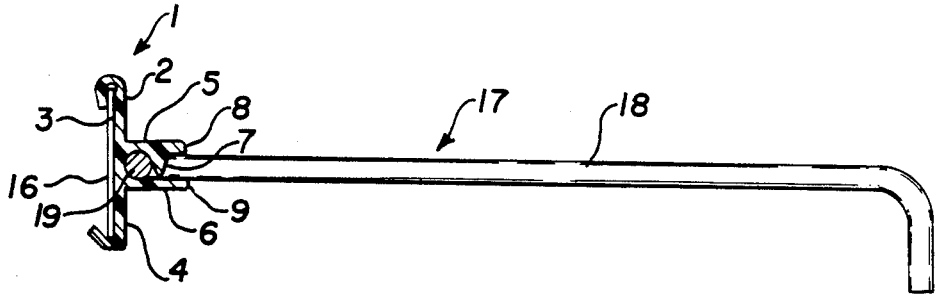
FIG. 2 is a vertical section through the tag holder taken along the line 2—2 in FIG. 1.
Figure 3:
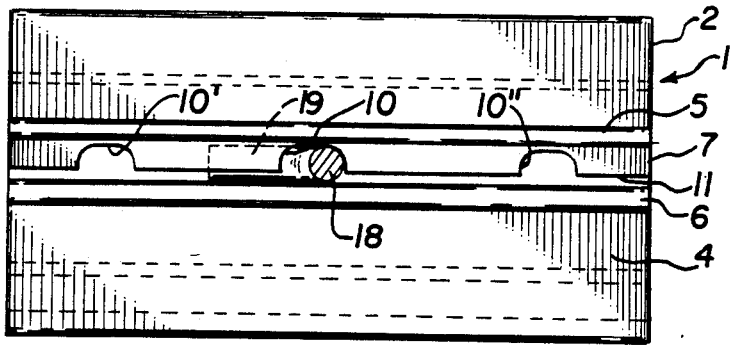
FIG. 3 is a rear elevational view of the tag holder of FIG. 1 taken through the support rod.
Figure 5:
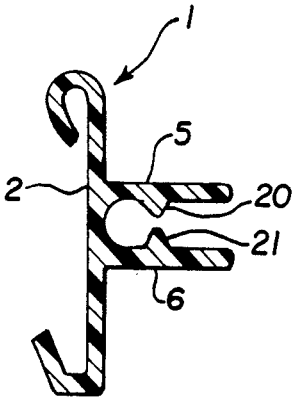
FIG. 5 is a vertical section through the tag holder of FIG. 4 taken along the lines 5—5.
Figure 4:
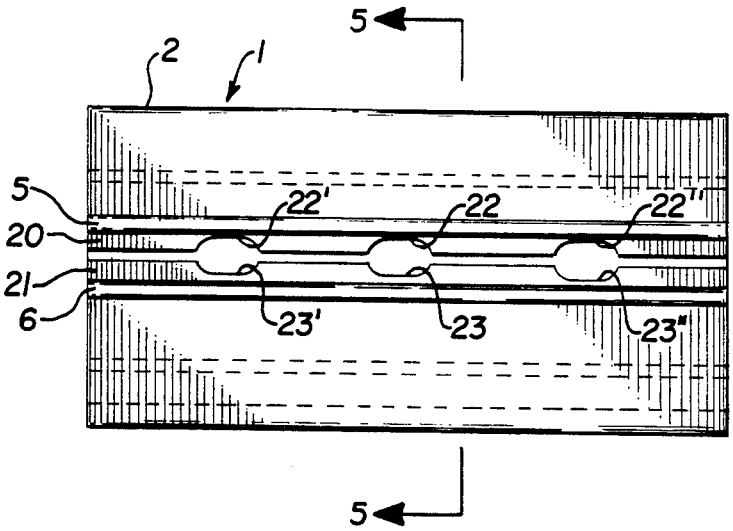
FIG. 4 is a rear elevational view of a second embodiment of the tag holder according to the invention.

FIGS. 4 and 5 illustrate another embodiment of the invention in which a pair of confronting ribs 20 and 21 project toward each other from the flanges 5 and 6 respectively. Aligned notches 22 and 23 in these ribs 20 and 21 respectively accommodate the shaft of a support arm (not shown). As in the embodiment of FIGS. 1 through 3, additional pairs of notches 22' and 23', and 22'' and 23'' are provided in the ribs for flexibility in mounting the tag holder 1 on a support arm.

Figure 6:
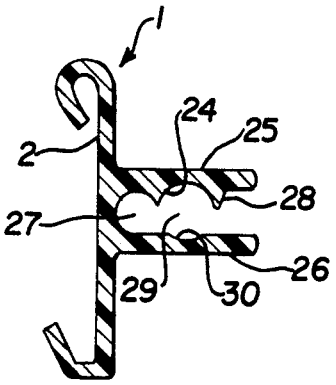
FIG. 6 is a vertical section through another embodiment of the invention.

Yet another embodiment of the invention, which can be used with two different sizes of support rods, is illustrated in FIG. 6. In this tag holder, a first rib 24 similar to the rib 7 in the embodiment of FIGS. 1 through 3 projects from the flange 25 toward the parallel flange 26. The spacing of the flanges and the rib 24 is such as to provide a passage 27 in which the transversely bent end portion of a support rod is tightly gripped. Outwardly spaced from the rib 24 is a second rib 28 which forms with the inner rib 24 and the flanges 25 and 26 a second passage 29 in which the end portion of a support rod of larger cross-section may be tightly gripped. If desired, a depression 30 may be provided in the bottom flange to provide additional support for the larger support rod. The ribs 24 and 28 are provided with one or several notches as in the embodiment of FIGS. 1 through 3 to accommodate the shaft of the respectively sized support arms.

While specific embodiments of the invention have been described in detail, it will be appreciated by those skilled in the art that various modifications and alternative to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

I claim:

1. A tag holder adapted for use in connection with a support rod having a shaft portion and an end portion extending laterally from the end of the shaft portion; said tag holder comprising:

a resilient planar member having a front face and a rear face;

a pair of parallel flanges integral with and projecting transversely from the rear face of said planar member and extending across a substantial portion of the width of said rear face; and an integral rib projecting from at least one flange toward the other flange along a substantial portion of the length of said one flange and terminating in a free edge, said rib defining a notch therein extending from said free edge toward said one flange, said flanges being spaced apart, the rib being spaced from the rear face of the planar member, and said notch being sized such that, said flanges may be spread apart to snap said rib over the end portion of the rod with the shaft passing through the notch to snugly grip the end portion of the support rod between the flanges and between the rib and the rear face of the planar member, said flanges projecting outwardly from the rear face of said planar member beyond said rib such that with said tag holder engaging the end portion of the rod, the portions of said flanges which project outwardly beyond said rib engage the top and bottom of said shaft protion of the rod to prevent rotation of the tag holder about the end portion of the rod.

2. The tag holder of claim 1 wherein said rib defines a plurality of notches therein extending from the free edge toward said one flange, each of said notches being sized such that said flanges may be spread apart to snap said rib over the end portion of the rod with the shaft passing through one of said notches, said notches being spaced along said rib to provide selective lateral positioning of the tag holder relative to the shaft of the support rod.

3. The tag holder of claim 1 wherein said planar member is substantially rectangular in configuration with a top and bottom edge, said top and bottom edges being turned back over the front face of the planar member to form horizontal grooves in which a tag may be retained.

4. The tag holder of claim 1 wherein integral confronting ribs project from each flange toward the other flange and terminate in adjacent free edges, and wherein the confronting ribs define aligned notches in the adjacent free edges, said notches being sized such that, said flanges may be spread apart to snap the ribs over the end portion of the support rod with the shaft passing through the aligned notches.

5. The tag holder of claim 4 wherein said ribs define a plurality of aligned notches spaced along the ribs to provide selective lateral positioning of the tag holder relative to the shaft of the support rod.

6. The tag holder of claim 5 wherein said flanges project outward from the rear face of said planar member beyond said ribs such that with said tag holder engaging the end portion of the rod, the portions of said flanges which project outward beyond said ribs engage the top and bottom of said shaft portion of the rod to prevent rotation of the tag holder about the end portion of the rod.

7. In combination, a support rod having a shaft portion and a transversely bent end portion; and a tag holder comprising;

a resilient planar member having a front face and a rear face, a pair of parallel flanges integral with and projecting transversely from the rear face of said planar member and extending across a substantial portion of the width of said rear face, and an integral rib projecting from at least one flange toward the other flange along a substantial portion of the length of said one flange and terminating in a free edge, said rib defining a notch therein extending from said free edge toward said one flange, said flanges being spaced apart, said rib being spaced from the rear face of said planar member, said shaft of said support rod passing through said notch, with the end portion of said support rod being snugly gripped between said flanges and between said rib and said rear face of said planar member.

8. The combination of claim 9 wherein said tag holder includes a second integral rib projecting from at least one flange toward the other flange along a substantial portion of the length of said one flange and terminating in a free edge, said second rib defining a second notch therein extending from the free edge toward said one flange, said second rib being parallel to and spaced from the first mentioned rib in a direction remote from the planar member, said second notch being sized and the flanges between said ribs being spaced such that selectively, in place of snapping the first mentioned rib over the end portion of said first mentioned support rod, said flanges may be spread apart to snap the second rib over the laterally extending end portion of a second support rod which is larger in cross-section than the first mentioned support rod with the shaft of the second support rod passing through the second notch to snugly grip the end portion of the second support rod between the flanges and between the two ribs.

9. The combination of claim 8 wherein said flanges on said tag holder project outward from the rear face of said planar member beyond said second rib such that with said tag holder engaging the end portion of the rod, the portions of said flanges which project outward beyond said second rib engage the top and bottom of said shaft portion of the rod to prevent rotation of the tag holder about the end portion of the rod.

* * * * *